US007350836B2

(12) United States Patent
Simpson

(10) Patent No.: US 7,350,836 B2
(45) Date of Patent: Apr. 1, 2008

(54) DOOR SECURITY SYSTEM

(75) Inventor: Robert David Simpson, Rickmansworth (GB)

(73) Assignee: RDS Innovations Limited, Rickmansworth, Hertfordshire (GB)

( * ) Notice: Subject to any disclaimer, the term of this patent is extended or adjusted under 35 U.S.C. 154(b) by 609 days.

(21) Appl. No.: 10/486,995

(22) PCT Filed: Aug. 7, 2002

(86) PCT No.: PCT/GB02/03653

§ 371 (c)(1),
(2), (4) Date: Feb. 13, 2004

(87) PCT Pub. No.: WO03/016663

PCT Pub. Date: Feb. 27, 2003

(65) Prior Publication Data

US 2004/0239501 A1 Dec. 2, 2004

(30) Foreign Application Priority Data

Aug. 17, 2001 (GB) ..... 0120107.8

(51) Int. Cl.
*E05C 3/02* (2006.01)
*E05C 17/16* (2006.01)

(52) U.S. Cl. ..... 292/194; 292/80; 292/89; 292/304; 292/DIG. 15; 16/82

(58) Field of Classification Search ..... 292/194, 292/80, 89, 144, 201, 288, 304, DIG. 15, 292/DIG. 19; 16/82, 83
See application file for complete search history.

(56) References Cited

U.S. PATENT DOCUMENTS

| | | | | | |
|---|---|---|---|---|---|
| 211,660 | A | * | 1/1879 | Hotchkiss | 16/64 |
| 1,940,027 | A | * | 12/1933 | Smith | 292/201 |
| 3,096,940 | A | * | 7/1963 | Burleigh | 239/272 |
| 3,150,894 | A | * | 9/1964 | Sant | 292/201 |
| 3,189,936 | A | * | 6/1965 | Lee | 16/82 |
| 3,796,451 | A | * | 3/1974 | Schultz | 292/263 |
| 4,115,897 | A | * | 9/1978 | Zunkel | 16/49 |
| 5,386,713 | A | * | 2/1995 | Wilson | 70/280 |
| 5,553,353 | A | * | 9/1996 | Lin | 16/82 |
| 6,322,308 | B1 | * | 11/2001 | Grant | 411/429 |

FOREIGN PATENT DOCUMENTS

| | | | |
|---|---|---|---|
| GB | 2058204 | * | 4/1981 |
| WO | WO0073609 | * | 12/2000 |

* cited by examiner

*Primary Examiner*—Carlos Lugo
(74) *Attorney, Agent, or Firm*—Galgano & Associates, PLLC

(57) ABSTRACT

A security system for constraining the degree to which a door leaf (11) may be opened; the system being selectively activated from an inoperative position in which it does not block the opening and closing of the door leaf (11), into and out of an operative position in which it does so block the opening of the door leaf (11) beyond a predetermined constrained degree; the system being characterized in that it comprises: a chassis (14) adapted for mounting, in use, adjacent an opening edge of a door leaf (11); an electric actuator (17, 28, 36) mounted on the chassis (14); an arm (18, 29, 37) operating in conjunction with said actuator (17, 28, 36) so that the actuator drives the motion of said arm (18, 29, 37) without any lost motion mechanism.

11 Claims, 3 Drawing Sheets

DOOR SECURITY SYSTEM

FIELD OF THE INVENTION

The invention relates to door security systems and is specifically concerned with a security system for constraining the degree to which a door leaf may be opened.

REVIEW OF ART KNOWN TO THE APPLICANT

Security systems adapted for the purpose just outlined are known generally and several examples of them can be studied in, for example, published PCT Patent Application No WO 00/73609 A1 (RDS Innovations Limited) and the several cited documents brought forward against its claims when it was searched.

Document WO 00/73609 A1 is the closest prior art currently known to the applicant and it acknowledges that the basic principle of the moving arm physically blocking the opening of the door leaf is sound. This principle forms the framework for this current invention and document WO 00/73609 A1 forms the starting point for the present invention.

This document describes and illustrates several differing embodiments of a door security system. Each of these embodiments is complex in nature.

One of these embodiments comprises an arm carried on a chassis which in use is mounted adjacent an edge of the door leaf. The arm comprises a steel plate bent at one end to form a door retaining tab. The displacement of the arm from its inoperative position to its door blocking position is achieved by a spring which releases its potential energy when a solenoid causes a release arm to free the arm. Apart from this solenoid, there is also provided a motor to drive the arm from its blocking position to its inoperative position while charging the spring.

There are also no means specified to retain the arm in a particularly advantageous blocking position. In activation the arm swings through approximately 180° and may even impact on the door leaf prior to any required blocking. This particular prior art embodiment presents an over-complicated door blocking system which is incapable of achieving precise door blocking.

Another WO00/73609 A1 embodiment presents a ram-driven (i.e.hydraulic) piston used to pivot a blocking arm. The control of such a system has not been detailed in that application.

Means of achieving such control would therefore be left to the skilled person in the art who would find it particularly difficult to put into practice.

OBJECTS OF THE INVENTION

This current patent application aims to provide an improved system for restraining the degree to which a door leaf may be opened.

One of the objectives of this invention is to provide a system with a minimum number of components which would enable rapid manufacture at a low cost.

A further objective of this invention is to provide a locking arm which can be precisely controlled.

An additional aim of this invention is to provide a system which can be improved in terms of its ability of preventing forced entry.

A further objective of this invention is to provide a system which can be placed adjacent to the doors edges no matter in what direction the door opens and which may be removed from one position to another by the user of the security system.

Various deterrent and/or identification systems are also speculated in this published WO 00/73609 A1 document. Audible and/or visual alarms, visual image detection means, dye-release and pressure-sensing add-ons are all covered and in general, the document gives a pretty comprehensive overview of what might be done but without concentrating on any specific preferred design, it is therefore another objective of this present invention to propose a particularly advantageous deterrent and/or identification system.

SUMMARY OF THE PRESENT INVENTION

In its broadest aspect the invention provides a security system for constraining the degree to which a door leaf may be opened; the system being selectively activated from an inoperative position in which it does not block the opening and closing of the door leaf, into and out of an operative position in which it does so block the opening of the door leaf beyond a pre-determined constrained degree; the system being characterised in that it comprises:

A chassis adapted for mounting, in use, adjacent an opening edge of the door leaf;

An electric actuator mounted on the chassis;

An arm operating in conjunction with the said actuator that the actuator drives the motion of the said arm without any lost motion mechanism.

This combination of features advantageously simplifies this type of door locking system. It dramatically reduces the number of components necessary to achieve the necessary motion of the arm. This improved version is therefore more cost effective.

A further advantage of this configuration is that the position of the arm is more accurately controlled as the arm operates in conjunction with the actuator so that the actuator drives the motion of the arm.

A subsidiary aspect of the current invention in accordance with its broadest aspect presents a system wherein the actuator drives the rotation of the arm.

Arranging this system so that the actuator drives the rotation of the arm is particularly advantageous because it facilitates the precise angular positioning of the arm.

In a further subsidiary aspect according to the broadest independent aspect of the invention, the actuator is a motor and the arm is mounted directly on the output shaft of that motor in such a way that when the motor shaft rotates, the arm rotates with it.

Central to this aspect is the decision to use a motor to drive the arm through no intermediate gearing by mounting it directly on the motor output shaft. This stems from the fundamental realisation that, provided that the arm physically blocks the door leaf when necessary, the arm itself need only be a lightweight component. It is not necessary for it to be structurally complicated, in contrast to what is taught in WO00/73609A1, because its mere physical presence as a barrier in the path of the opening door leaf is all that is actually needed.

Directly mounting the arm on the output shaft of the motor, also permits the advantageous control of the position of the arm.

In an additional aspect of the current invention, the chassis mounting means is of a kind whereby in use the chassis when mounted will be secured primarily to the wall, bulkhead or other basic load-bearing structure surrounding the door rather than being secured primarily to the intermediate door frame or the like.

Securing the chassis primarily to the wall rather than primarily to the intermediate door frame further improves the blocking ability of this system.

In a further subsidiary aspect, the actuator is a motor and the motor operates under direct current to produce a non-step-by-step rotation, when the motor is in use.

In WO00/73609A1 the motors envisaged are stepping motors fed by AC current. It is well known that this type of motor can achieve a rapid rotation, however it also requires relatively complex control functions. The current invention marks a fundamental departure from the whole teaching of this prior document because its stems from the realisation that a short distance, only of travel of the arm (hence a relatively slow swing arc) is all that is actually needed to bring it into blocking engagement with the door leaf edge. The selection of motor in this current invention further contributes to simplifying the elements required to drive the arm. The present configuration may for example employ a low torque 12 volt motor and achieve accurate blocking and sufficiently rapid motion from the inoperable position to the blocking position. Another realisation stemming from this one is that accordingly the arc through which the arm of WO 00/73609 A1 first embodiment swings could be restricted; far from needing to be the best part of 180° as in that embodiment's illustrated teaching (FIG. 3) therein.

In further preferred subsidiary aspects of the invention the following features are apparent:

The arm rotates through no more than approximately 120 degrees when moving from its inoperative position into its door leaf blocking position.

The pivotal arc of movement of the arm from its inoperative position into its blocking position could be as little as 30 degrees and may advantageously lie within the range 30 degrees to 100 degrees.

The arc of movement of the arm from its inoperative position into its blocking position lies preferably within the range 90 degrees to 100 degrees.

As for the scatter-gun approach of listing every conceivable (but already known in themselves individually) alternative add-on, again the present invention rejects this in favour of entirely new thinking. Ideally a security system embodying the invention will incorporate only those features which truly give an inventive combination of utility and comprehensive action.

Any opening—or attempted opening beyond a certain sensed pressure—of the door leaf triggers automatically a dumping from the system of a liquid of the kind made distinctive for example by ultra-violet light and whose characteristics are such that, once a person bearing any of the liquid has been thus identified, the security system from which that specific liquid came can be established beyond reasonable doubt.

In a further subsidiary aspect, the means securing the chassis in use to the surrounding primary load-bearing structure comprise coach bolts or the like which are long enough to pass if necessary through a frame surrounding the door leaf and into the primary load-bearing structure surrounding the door unit as a whole.

Incorporating into the current system the above feature is particularly advantageous because it strengthens the locking ability of the system and therefore reduces the likelihood of forced entry.

In a further subsidiary aspect, the actuator is a motor and the arm movement into and out of its door leaf blocking position is effected solely by the rotation of the motor output shaft with essentially no other arm urging means being deployed.

This particular configuration presents a further improved version of this type of system with minimal components in order to enable simplicity during the function of the system and in its assembly.

In an additional subsidiary aspect, the actuator causes the arm to displace into and out of its blocking position along a line of action which is essentially parallel to the face of the door leaf whilst being spaced therefrom.

This aspect is particularly advantageous because it minimises the required travel distance covered by the arm when it displaces into and out of its blocking position.

In a further subsidiary aspect, the arm operates in conjunction with the actuator so that the arm in its inoperative position does not traverse the axis of the door leaf's adjacent edge.

This latest aspect is particularly advantageous because it enables the system to be placed adjacent to the door leaf irrespective of the door leaf's opening direction.

DETAILED DESCRIPTION OF THE DRAWINGS

Figure 1:
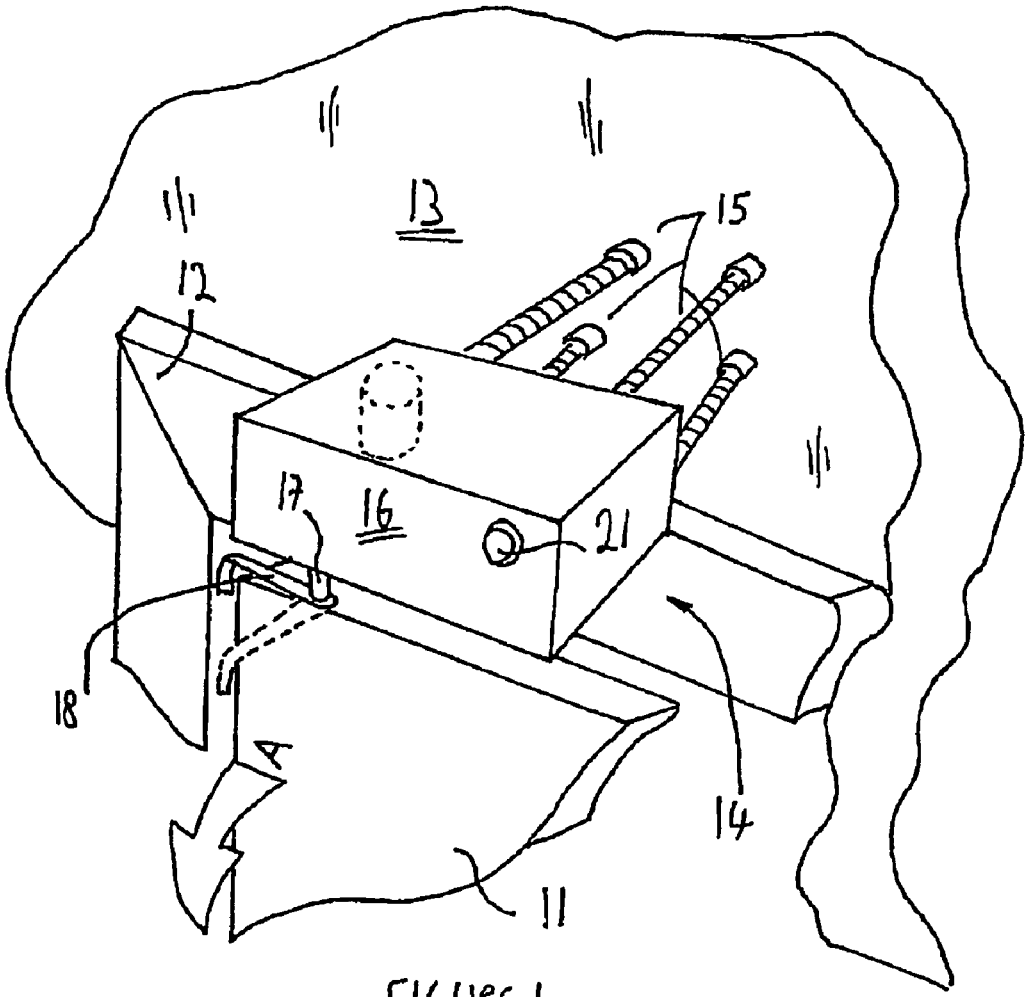
FIG. 1 shows, in diagrammatic perspective view, a security system embodying the invention mounted in use adjacent the top opening edge of a door leaf.

The drawing shows schematically the opening edge region of a door leaf 11 conventionally hinged (by means not illustrated) within a similarly conventional frame 12 fixed to surrounding brickwork 13. The brickwork 13 forms the primary load bearing structure into which the door opening is cut.

A chassis 14 is mounted in this instance directly to the brickwork 13 by coach bolts 15 of known kind. These bolts 15 locate the chassis 14 above the top rail of the door frame 12. Although there is no obvious reason why, as long as the bolts 15 are long enough, the chassis 14 could not be mounted so as to sandwich the top rail of the frame 12 between itself and the brickwork 13 with the coach bolts 15 then passing through the top rail before they enter the brickwork in which they are finally embedded, this preferred direct-to-brickwork mounting is far more advantageous as will be apparent later.

The chassis 14 comprises a back plate, from which the coach bolts 15 project as shown, and a removable box-style cover. The cover referenced 16 in the drawing is rectangular in plan and in elevation and may be of conventional formation. The means securing it removably to the coach bolt bearing back plate of the chassis 14 can similarly be selected from known alternatives.

Inside the cover 16 and not shown in the drawings is a conventional 12 volt low torque ungeared electric motor. Its output shaft 17 projects from the underside of the cover 16 and in front of the top rail of the door frame 12 through an appropriate aperture in the cover. Fixed to the extremity of shaft 17 is a T-shaped lightweight metal arm 18 which itself ends in a right-angled tab as shown. Activation of the motor by any of the intruder-sensitive means canvassed in the previous documents causes the shaft 17 to rotate and to take with it the arm 18 into the broken-line position shown in the drawing.

In that broken-line position the end tab of the arm 18 physically blocks the opening of the door leaf 11 in the direction of arrow A by anything other than a relatively small amount. Unauthorised intruders can therefore be prevented from entering. Resetting the arm 18 to its inoperative illustrated position can be accomplished by known alternatives and, as shown, the arm rotates through only approximately 90 degrees from its inoperative to its operative position.

A proximity detector 21 on the front face of the cover 16 may be linked to a video camera or other conventional equipment for monitoring the presence of people outside the door. But in practical preferred embodiments a communications port from the system will enable not only video cameras surveillance but also linkage to a health alarm loop, a police local warning loop, or other appropriate hook-up and these together with the rest of the system will be fully digitally controlled.

The proximity detector 21 is shown as part of the chassis box. It may (although not illustrated in this embodiment) be on the outside of the door or building and automatically trigger the movement of the arm from its inoperative position to its blocking position when an individual is detected in the vicinity of the door. In this configuration, the door security system does not require any manual activation, the access being advantageously under automatic control. In this particular configuration, it is also envisaged that the return of the arm to its inoperative position may be achieved manually rather than automatically.

Also incorporated into the system will be a so-called dye dump. This was speculated on but not developed in WO 00/73609 A1. Contrary to the lack of detail therein (the term "dye dump" could cover things which are literally illegal) the present invention specifically provides for the use of an ultra-violet identifiable liquid for example one which is of a type known currently under the name SMART WATER (a registered Trade Mark of SMART WATER LIMITED) and which is contained in a suitably incorporated canister within cover 16 and is automatically sprayed onto any unwarranted attempted intruder as or after the door leaf is opened and especially if an attempt is made to force it beyond the blocking presence of the in-use arm 18.

This liquid is dumped by an electronically controlled screw-in valve which activates automatically under preset door-opening conditions (or under predetermined pressure-sensed conditions whether or not the door is actually opened) and is supplied from store in canisters each of which has a different "tag" in that the liquid dispensed from a specific canister can uniquely be identified as having come from that canister.

It is a characteristic of this liquid that it cannot normally be seen but is immediately shown up under for example ultra-violet light. Anyone who has intruded or attempted to intrude past the closed door can thus be identified subsequently, for quite a long period of time before the effect wears off, even if he may not realise it at the time of his offence. Once so identified, the unique "fingerprint" of the particular liquid with which he was coated can be traced immediately back to a canister, located of course in a specific security system installation, and hence tie him beyond reasonable doubt to a recently recorded intrusion attempt on that system.

Mounting the chassis 14 directly onto the hard flat non-yielding brickwork 13 enables the tab of arm 18 to be of optimally minimum length; as the whole chassis/motor/arm unit will not flex unduly in use. Mounting the chassis via the door frame by contrast could permit undue flexing under load and the tab would have to have a safety margin lengthwise to allow for this possibility. The preferred example would be both neater, and less prone to fouling with repeated use, on that basis.

Figure 2:
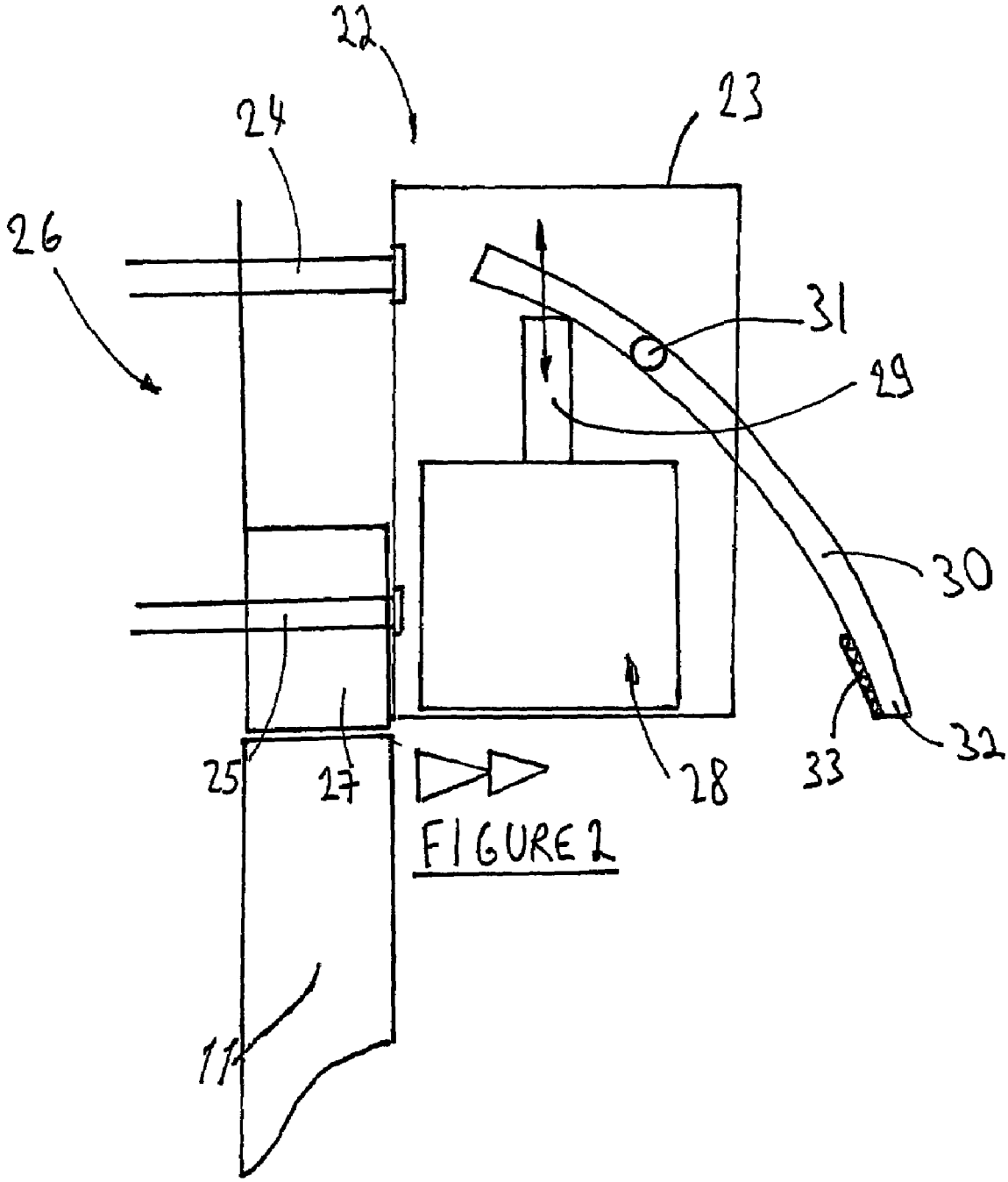
FIG. 2 presents a diagrammatic cross sectional side view of the security system in a further embodiment of the invention.

FIG. 2 presents a further embodiment of the present invention, where the door security system is generally referenced at 22. This door security system comprises a chassis 23 which is attached to a wall 26 via four appropriate screw means of which only screw means 24 and 25 are represented in the drawing. Screw means 25 traverses a section of the door frame 27 and extends into wall 26 to ensure that the wall acts as the primary load-bearing structure.

Chassis 23 is essentially boxed shaped and sufficient in size to house a rotor 28. Rotor 28 operates in conjunction with screw mechanism 29 which when actuated upon moves up or down in order to cause the displacement of arm 30. The pivot point 31 is located at a quarter of the length of the arm 30 so that small displacements by the linear actuator formed by rotor 28 and screw mechanism 29 result in large displacements of arm 30 at its free extremity 32. This particular arrangement is advantageous because it economises the required displacement of the linear actuator and therefore reduces its overall power consumption. This is a particularly important consideration when this linear actuator is powered by DC current as envisaged in one particularly advantageous aspect of this invention.

In this embodiment, the arm is adapted to slidably engage with the linear actuator and it is also envisaged that the screw mechanism comprises a retaining means (not illustrated in the drawing) in order to prevent the arm from pivoting under gravity. The cross section of the arm is also an important consideration in this embodiment and the applicant considers that an I-section is particularly suited to the particular loading conditions of this system.

The illustration of FIG. 2 presents the door security system in its open configuration where it allows the door leaf 11 to open freely. From this configuration, the rotor 28 would drive screw mechanism 29 in the upward direction thus causing the arm to pivot around point 31 in the clockwise direction until arm 30 reaches its blocking position.

In its blocking position, the load would be primarily transmitted to the chassis via the pivot point 31 and to the wall or other load bearing structure via the screw attachment means, two of which are illustrated at 24 and 25.

This door security system comprises no component on the door itself and therefore distinguishes itself fundamentally from some prior art systems that do.

The invention also envisages the incorporation of cushioning means 33 on the free extremity 32 of arm 30 to prevent any damage (although unlikely) to the door's face which would result from the repeated operation of the system over time.

Figure 3:
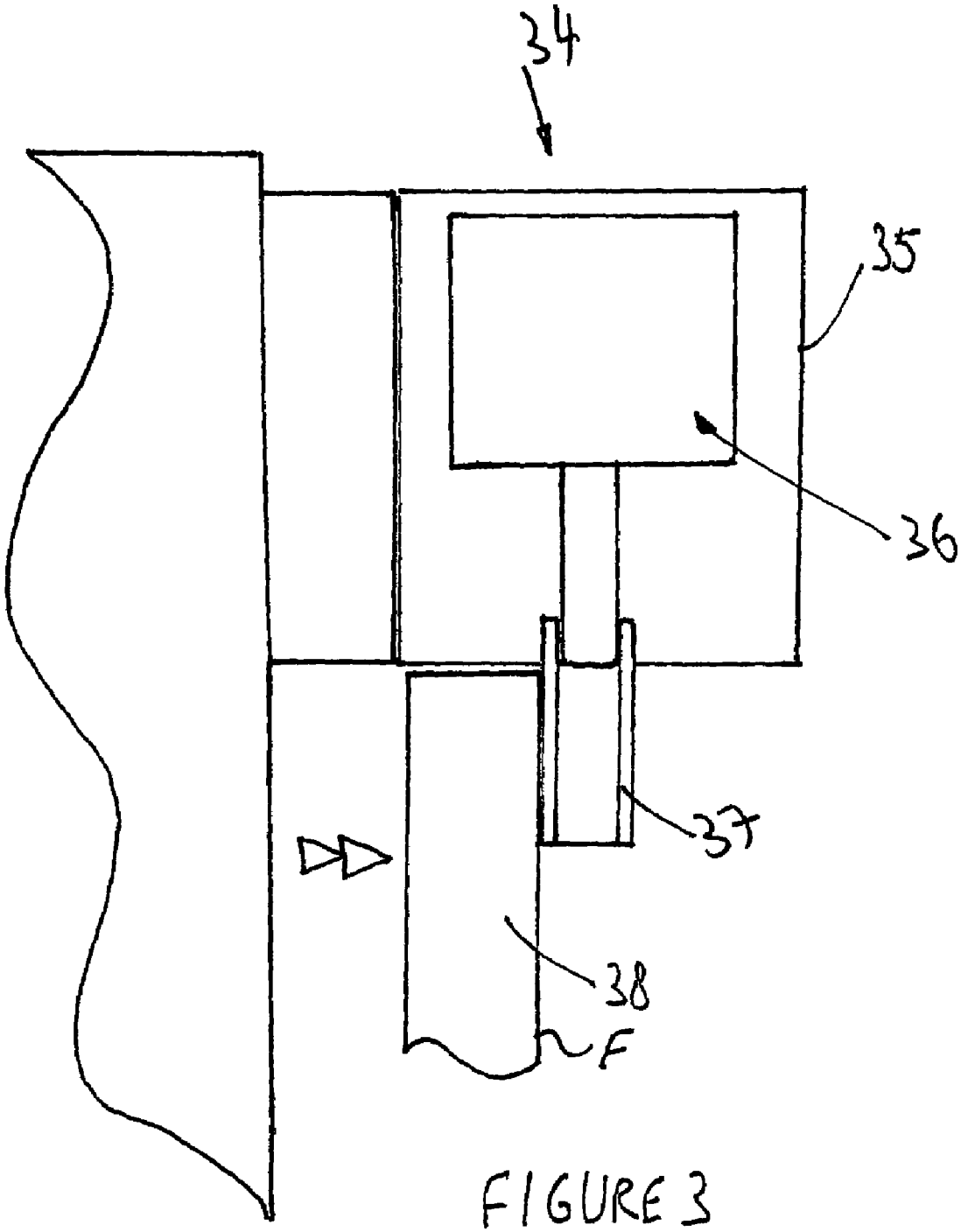
FIG. 3 shows a diagrammatic cross sectional side view of a further embodiment of the invention.

FIG. 3 presents a further door security system generally referenced at 34. As in the previous embodiments, it comprises a chassis 35 designed to enclose a linear actuating means 36. This linear actuating means drives an arm 37 in such a way that it extends and retracts from the chassis along a line of action which is essentially parallel to the face F of the door leaf 38. The illustration of FIG. 3 shows the arm 37 in its blocking mode fully extended out of its chassis. In this configuration, door leaf 38 is held against arm 37 in a partially opened position sufficient for audible communication from inside to outside to tale place and also permitting the passage of small objects such as a parcel, while at the same time preventing the entry of any person from the outside to the inside of the door. When the door is closed (not illustrated in the drawings) the line of action of the arm is essentially parallel face of the door leaf whilst being spaced there from.

The invention also envisages that notices may be affixed to the outside face of the door leaf and adapted to display, for example the following information comprising:

A warning text ('you are being filmed by CCTV')

Device or logo indicating in generally recognised terms a connection with authority, for example, a Police dogs profile or a Policeman figure A specific text ('this door is alarmed and is connected to the nearest area Police Station electronically')

It is also envisaged in this invention that self adhesive, self illuminated, or other notices of this kind are being incorporated on the door leaf itself or nearby to be readily viewed by any visitor. It is thought that these self adhesives or the like could be supplied by local Police authorities (particularly for the Elderly) for use in conjunction with the current invention or alone in their own right.

The invention claimed is:

1. In a security system for constraining the degree to which a door leaf may be opened of the type having an inoperative position in which it does not block the opening and closing of the door leaf, and an operative door leaf blocking position in which it does so block the opening of the door leaf beyond a predetermined constrained degree and means for selectively activating said system for effecting movement between said inoperative and operative position, the improvement comprising:

a chassis;

means for mounting said chassis adjacent an opening edge of said door leaf;

an electric actuator comprising a motor having a rotatable output shaft;

means for mounting said electric actuator on said chassis;

an arm operating in response to movement of said output shaft of said actuator, whereby said actuator drives said arm without any lost motion mechanism into and out of said operative position, at least a portion of said arm when in said operative position is moved into a position beyond said chassis, where said arm acts as a barrier to said door leaf being opened beyond a predetermined degree; and means for mounting said arm directly on said output shaft of said motor, so that when said motor shaft rotates, said arm rotates with it, and wherein said arm movement into and out of its operative door leaf blocking position is effected solely by the rotation of said output shaft with essentially no other arm-urging means being deployed.

2. A system according to claim 1, wherein said means for mounting the chassis includes means for mounting said chassis on a load bearing structure surrounding the door.

3. A system according to claim 1, wherein said motor operates under direct current to produce a non-step-by-step rotation, when said motor is in use.

4. A system according to claim 1, wherein said arm rotates through no more than approximately 120 degrees when moving from its inoperative position into its operative door leaf blocking position.

5. A system according to claim 4, wherein the pivotal arc of movement of said arm from its inoperative position into its operative blocking position lies within the range of 30 degrees to 100 degrees.

6. A system according to claim 5, wherein said arc of movement of said arm from its inoperative position into its operative blocking position lies within the range 90 degrees to 100 degrees.

7. A system according to claim 1, wherein said actuator is a 12 volt ungeared motor.

8. A system according to claim 1, additionally comprising means for dumping a liquid and means for triggering the dumping of a liquid when pressure applied to said door leaf is in excess of a predetermined level, the liquid being identifiable and whose characteristics are such that, once a person bearing any of the liquid has been thus identified, the security system from which that specific liquid came can be established.

9. A system according to claim 1, wherein said means for mounting the chassis includes attachment means which are long enough to pass through a frame surrounding the door leaf and into a primary load-bearing structure surrounding the door unit as a whole.

10. A security system according to claim 1, wherein said actuator causes said arm to displace into and out of its operative blocking position along a line of action which is essentially parallel to the face of said door leaf while being spaced therefrom.

11. In a door installation of the type comprising a door leaf and a security system for constraining the degree to which the door leaf may be opened, said system comprising means for selectively activating movement of said system from an inoperative position in which it does not block the opening and closing of the door leaf, into and out of an operative position in which it does so block the opening of the door leaf beyond a predetermined constrained degree, the improvement comprising:

a chassis;

means for mounting said chassis adjacent an opening edge of said door leaf;

an electric actuator comprising a motor having a rotatable output shaft;

means for mounting said electric actuator on said chassis;

an arm operating in response to movement of said output shaft of said actuator, whereby said actuator drives the motion of said arm without any lost motion mechanism into and out of said operative position, at least a portion of said arm when in said operative position is moved into a position beyond said chassis, where said arm acts as a barrier to said door leaf being opened beyond a predetermined degree; and means for mounting said arm directly on said output shaft of said motor, so that when said motor shaft rotates, said arm rotates with it and wherein said arm movement into and out of its operative door leaf blocking position is effected solely by the rotation of said output shaft with essentially no other arm-urging means being deployed.

* * * * *